US011646493B2

(12) United States Patent
Harel et al.

(10) Patent No.: US 11,646,493 B2
(45) Date of Patent: May 9, 2023

(54) WIRELESS TELECOMMUNICATION NETWORK ANTENNA

(71) Applicant: Nokia Shanghai Bell Co., Ltd., Shanghai (CN)

(72) Inventors: Jean-Pierre Harel, Lannion (FR); Zied Charaabi, Lannion (FR)

(73) Assignee: Nokia Shanghai Bell Co., Ltd., Shanghai (CN)

( * ) Notice: Subject to any disclaimer, the term of this patent is extended or adjusted under 35 U.S.C. 154(b) by 391 days.

(21) Appl. No.: 16/648,003

(22) PCT Filed: Sep. 20, 2018

(86) PCT No.: PCT/IB2018/057248
§ 371 (c)(1),
(2) Date: Mar. 17, 2020

(87) PCT Pub. No.: WO2019/058297
PCT Pub. Date: Mar. 28, 2019

(65) Prior Publication Data

US 2020/0266540 A1 Aug. 20, 2020

(30) Foreign Application Priority Data

Sep. 20, 2017 (EP) ..... 17306224

(51) Int. Cl.
*H01Q 5/307* (2015.01)
*H01Q 1/48* (2006.01)
(Continued)

(52) U.S. Cl.
CPC ..... *H01Q 5/307* (2015.01); *H01Q 1/246* (2013.01); *H01Q 1/48* (2013.01); *H01Q 1/521* (2013.01); *H01Q 21/26* (2013.01)

(58) Field of Classification Search
CPC ..... H01Q 1/246; H01Q 1/521; H01Q 1/523; H01Q 1/526; H01Q 5/40; H01Q 5/42;
(Continued)

(56) References Cited

U.S. PATENT DOCUMENTS 6,072,439 A * 6/2000 Ippolito ..... H01Q 1/246 343/797
2005/0206575 A1* 9/2005 Chadwick ..... H01Q 21/24 343/797
(Continued)

FOREIGN PATENT DOCUMENTS

CN 103840254 A 6/2014
FR 2863111 A1 * 6/2005 ..... H01Q 1/246
(Continued)

OTHER PUBLICATIONS

International Search Report for PCT/IB2018/057248 dated Jan. 9, 2019.

*Primary Examiner* — Dameon E Levi
*Assistant Examiner* — Leah Rosenberg
(74) *Attorney, Agent, or Firm* — Lippes Mathias LLP

(57) ABSTRACT

The invention relates to a multiband antenna, in particular for wireless networks, comprising: —a ground plane (7) extending along a longitudinal axis (A), —high band radiating elements (9*a*) set at the extremities of crosses, inclined at 45° with respect to the longitudinal axis (A), with an arm length being a dyadic fraction of a high-band wavelength ($O_{HB}$), —low band radiating elements (9*b*) set at the extremities of crosses, inclined at 45° with respect to the longitudinal axis (A), with an arm length being a dyadic fraction of a low-band wavelength ($O_{LB}$), characterized in
(Continued)

Figure 1:
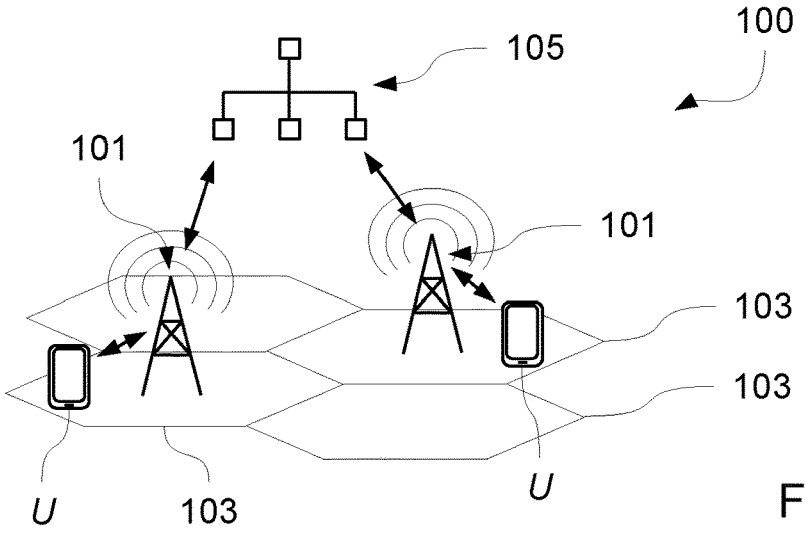

that the high and low band radiating elements (9*a*, 9*b*) crosses are arranged along the longitudinal axis (A) of the metallic ground plane (7), in that the antenna comprises tubular separation walls (13) in electric contact with the ground plane (7), and in that the crosses are arranged in a pattern, wherein: —at least part of the high-band radiating elements (9*a*) are set inside the tubular separation walls (13), —the low-band radiating elements (9*b*) are placed around the separation walls.

12 Claims, 3 Drawing Sheets

(51) Int. Cl.
*H01Q 1/52* (2006.01)
*H01Q 21/26* (2006.01)
*H01Q 1/24* (2006.01)

(58) Field of Classification Search
CPC .. H01Q 5/48; H01Q 5/49; H01Q 1/48; H01Q 5/307; H01Q 21/26
See application file for complete search history.

(56) References Cited

U.S. PATENT DOCUMENTS

| | | | | |
|---|---|---|---|---|
| 2007/0046558 | A1* | 3/2007 | Tillery | H01Q 1/246 343/797 |
| 2008/0111757 | A1* | 5/2008 | Bisiules | H01Q 5/42 343/803 |
| 2014/0139387 | A1* | 5/2014 | Jones | H01Q 21/30 343/794 |
| 2014/0368395 | A1 | 12/2014 | Dauguet et al. | |
| 2016/0285169 | A1 | 9/2016 | Shooshtari et al. | |
| 2017/0012364 | A1* | 1/2017 | Yang | H01Q 9/42 |
| 2018/0191075 | A1* | 7/2018 | Semonov | H01Q 9/16 |
| 2018/0331419 | A1* | 11/2018 | Varnoosfaderani | H01Q 21/0006 |
| 2020/0014097 | A1 | 1/2020 | Kim et al. | |
| 2020/0176892 | A1* | 6/2020 | Wang | H01Q 21/26 |

FOREIGN PATENT DOCUMENTS

| | | | |
|---|---|---|---|
| KR | 101750336 | B1 | 6/2017 |
| WO | WO 2005/055362 | A1 | 6/2005 |
| WO | WO 2012/055883 | A1 | 5/2012 |
| WO | WO 2016/114810 | A1 | 7/2016 |
| WO | WO 2016187701 | A1 | 12/2016 |
| WO | WO 2017/097164 | A1 | 6/2017 |

* cited by examiner

WIRELESS TELECOMMUNICATION NETWORK ANTENNA

The present invention concerns the field of telecommunication, in particular wireless communication using cross polar multiband antennae, in particular for intercellular communication in wireless network architectures.

In wireless digital networks the user equipments connect to network cell antennae which correspond to elementary network cells.

A network cell corresponds to the area where a user equipment will preferably connect to the cell antenna of the network cell, using roaming parameters. The data transmitted to and from the cell antenna is forwarded using intercellular antennae, which produce and receive a directional non isotropic radiation pattern, pointing generally in the direction of an intercellular receiver (see FIG. 1).

Such intercellular antennae are often multiband antennae, which generate two or more polarised signals at frequencies in different bands (high band and low band in two band mode). To generate such signals, the antennae comprise for example an array of radiating elements arranged in dipole motives, where low band dipoles and high band dipoles are arrayed so as to reduce interferences on a metallic ground plane. The dipole motives are in general crosses, inclined in particular at 45° with respect to a longitudinal axis of the antenna, or so called patch antennae which comprise electrodes in a two dimensional array.

The combination of a set of high band dipoles and a set of low band dipoles causes these antennae to be bulky and cumbersome, while they are meant to be integrated in the landscapes with minimal visual impact.

It is known to place the high band and low band dipoles as close to each other as possible, to reduce occupied space, but this increases the interferences, and therefore the available range or bandwidth.

Some antennae use two dimensional dipole patterns, with metallic reflector elements in the corners, but the antenna design where the dipoles are in a line enables discrete installation on, for example, a pole, mast or column.

Document EP 2 795 722 discloses the use of high band and low band dipole arrays arranged in line on an elongated ground plane. The high band and low band dipoles are set in alternating fashion, one high band dipole motif being set next to each low band motif. To reduce interference, the high band dipoles (or low band dipoles) are set within tubular metallic separation walls.

This architecture is relatively compact while reducing the inter-frequency interferences, but the alignment of high and low band dipoles along a longitudinal axis means that the obtained antenna is potentially long.

In order to overcome the aforementioned drawbacks, the present invention has for object a multiband antenna, in particular for wireless networks, comprising:

- a ground plane extending along a longitudinal axis,
- high band radiating elements set at the extremities of crosses, inclined at 45° with respect to the longitudinal axis, with an arm length being a dyadic fraction of a high-band wavelength,
- low band radiating elements set at the extremities of crosses, inclined at 45° with respect to the longitudinal axis, with an arm length being a dyadic fraction of a low-band wavelength, characterized in that the high and low band radiating elements crosses are arranged along the longitudinal axis of the metallic ground plane, in that the antenna comprises tubular separation walls in electric contact with the ground plane, and in that the crosses are arranged in a pattern, wherein:

- at least part of the high-band radiating elements are set inside the tubular separation walls,
- the low-band radiating elements are placed around the separation walls.

The multiband antenna thus obtained is shorter in length at equivalent number of dipole motives, and therefore at equivalent radiating power, while presenting reduced levels of interference.

The antenna may present one or more of the following characteristics, taken separately or in combination.

The high-band radiating elements are arranged at a regular interval along the longitudinal axis of the ground plane, and every second high band radiating elements is surrounded by a tubular separation wall.

The high band radiating elements are arranged at a regular interval along the longitudinal axis of the ground plane, and in that said high band radiating elements are placed two by two inside the tubular separation walls.

The high-band and low-band radiating elements respectively inside and outside a tubular separation wall are aligned along a common cross pattern.

The separation wall presents a square cross section, at the corners of which are placed the low band radiating elements.

The tubular separation walls comprise a parasitic element comprising an outward protruding flange of metallic material that covers at least partially the low band radiating elements.

The parasitic element further comprises four flaps, folded so as to be perpendicular to the metallic ground plane and pointing towards said metallic ground plane.

The high and low band radiating elements are placed on printed circuit boards screwed or riveted to the metallic ground plane, and in that the tubular separation walls are brazed, welded or soldered to the metallic ground plane.

The outlines of the printed circuit boards are parallel to the tubular separation wall surrounding it.

The radiating elements comprise diagonally opposite L-probes which are coupled to each-other with a 180° phase shift.

The invention also relates to the associated process for obtaining a multiband antenna, characterized in that it comprises the following steps:

- placing high band radiating elements in crosses on the longitudinal axis of a metallic ground plane,
- placing low band radiating elements around a subset of the high band radiating elements,
- soldering, welding or brazing of tubular separation walls around at least the subset of the high band radiating elements, placed so as to surround the high band radiating elements, and to be surrounded by the low band radiating elements.

The process may further comprise the step of placing a metallic parasitic element on top of the tubular separation walls, comprising an outwards protruding flange covering at least partially the low band radiating elements.

Figure 2:
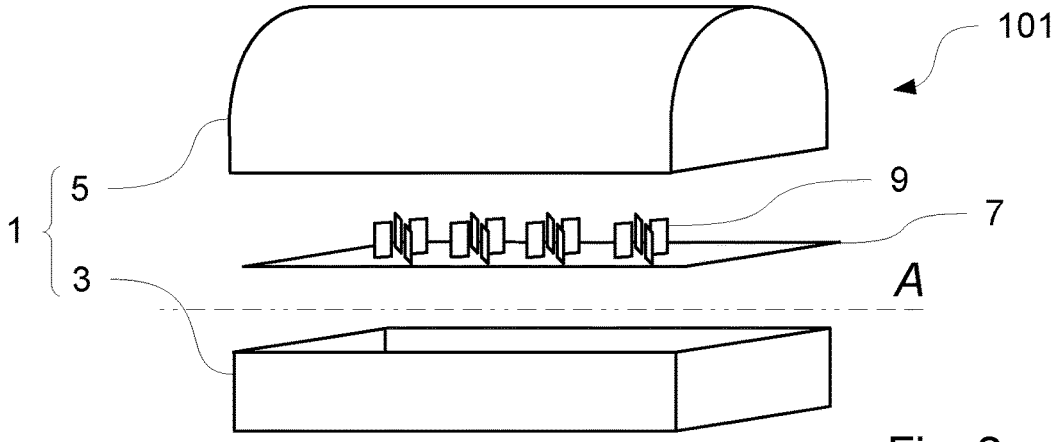
Figure 3:
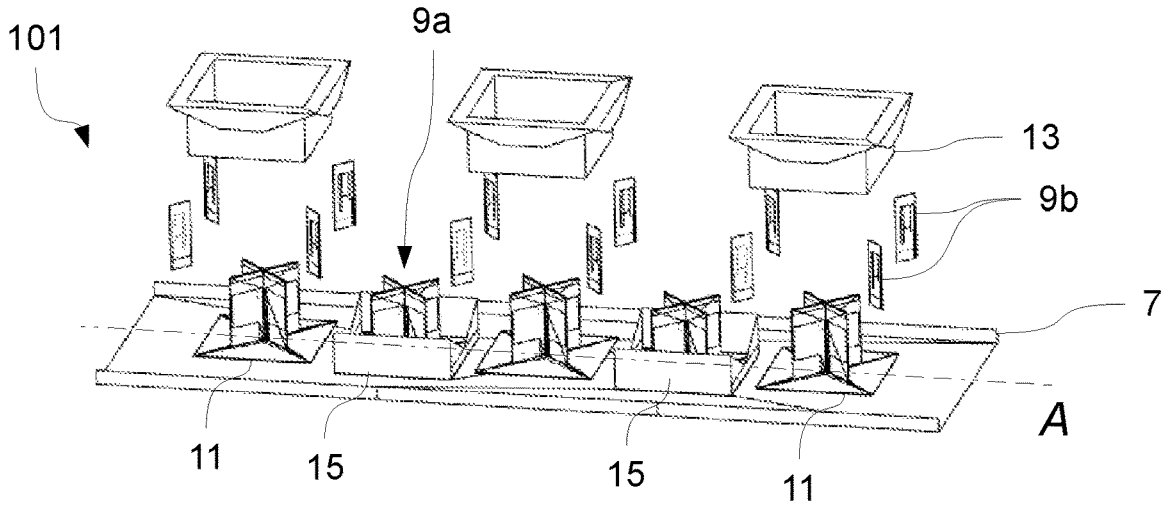
Figure 4:
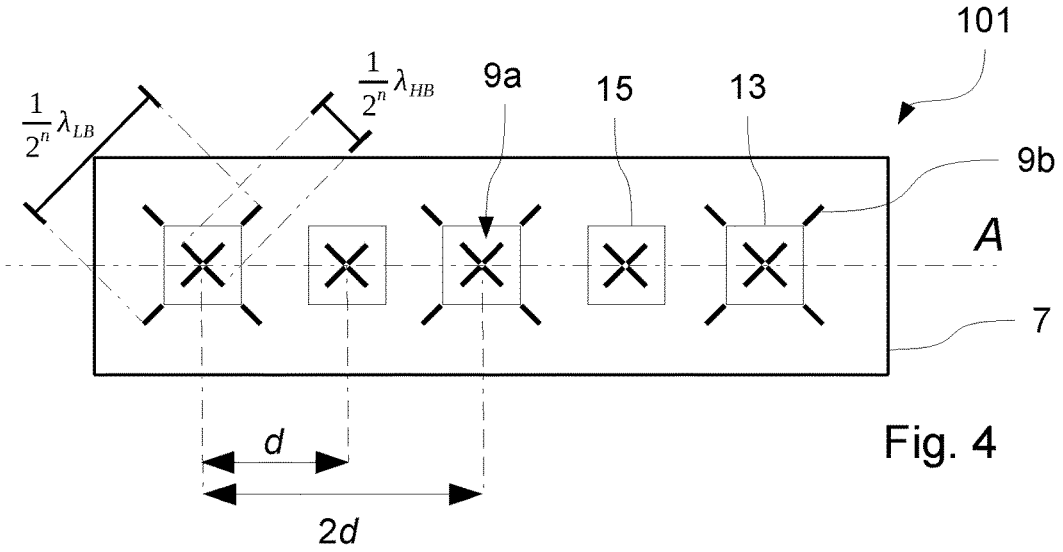
Figure 5:
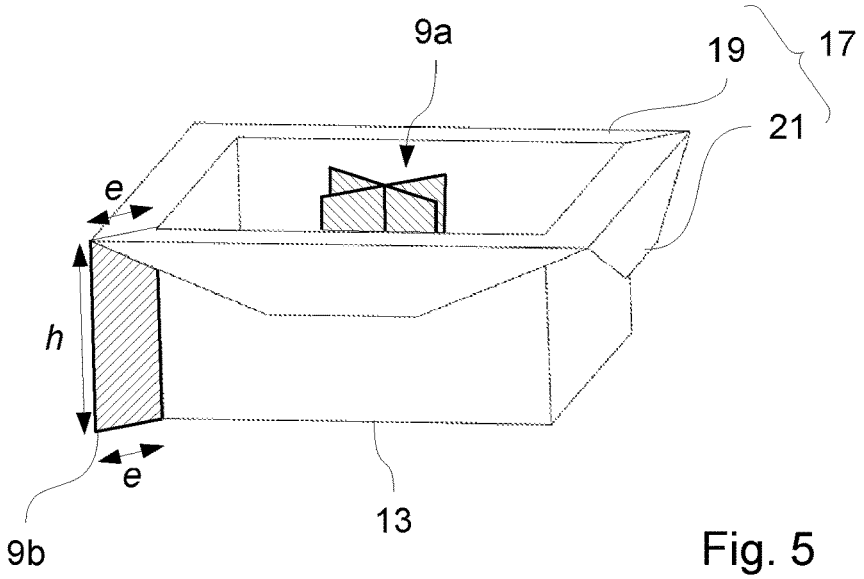
Figure 6:
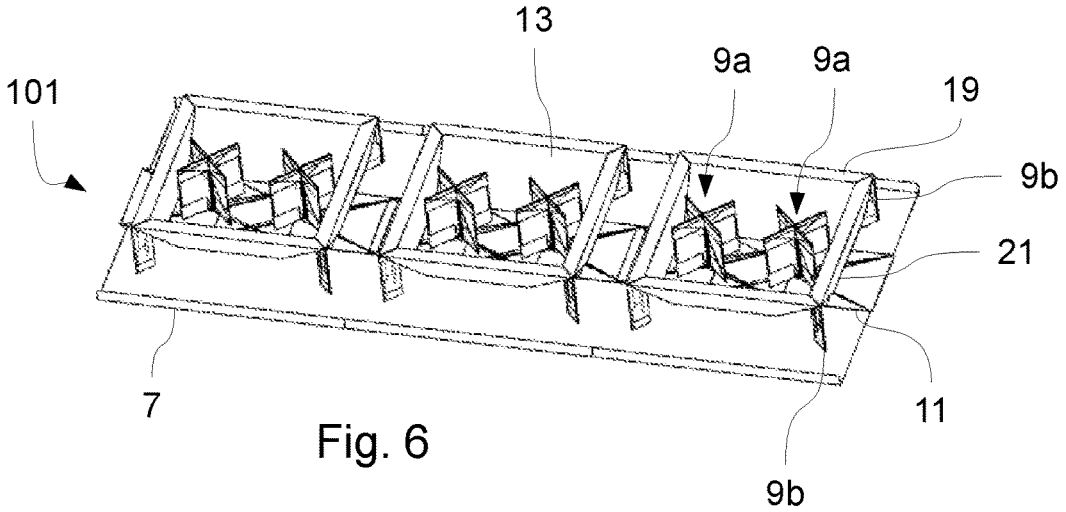
Figure 7A:
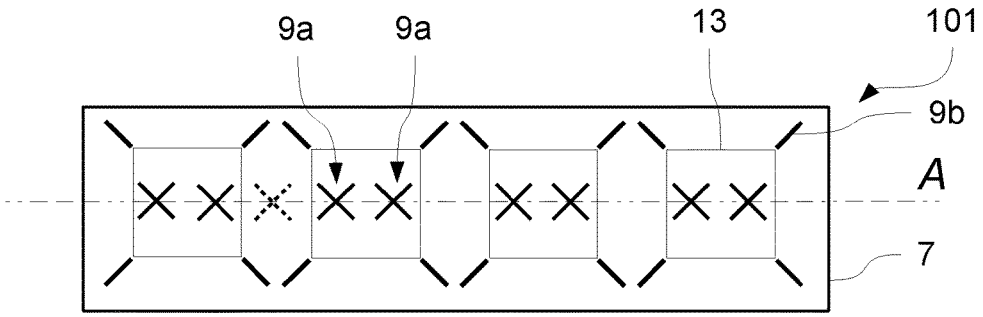
Figure 7B:
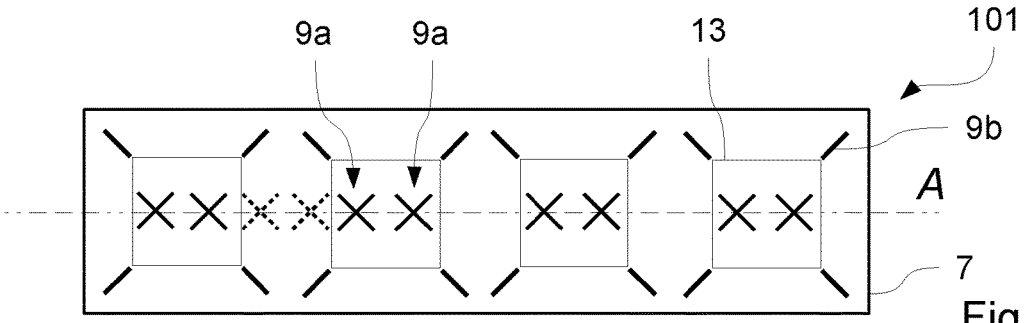
Figure 8:
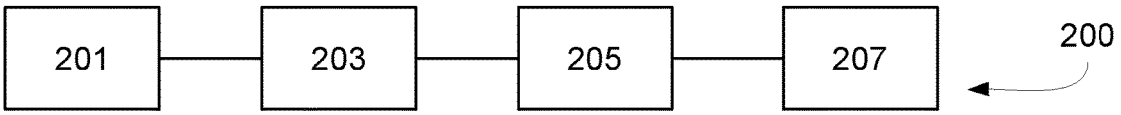
Figure 9:
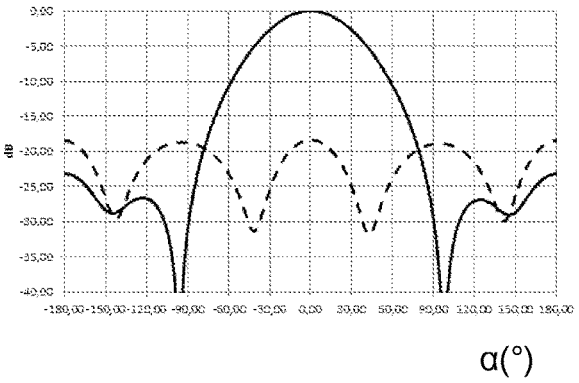
Figure 10:
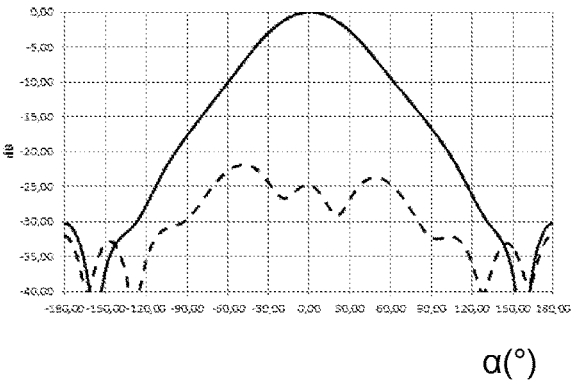

Other characteristics and advantages of the invention will appear at the reading of the following description, given in an illustrative and not limiting fashion, of the following figures, among which:

FIG. 1 is a schematic representation of a portion of a wireless network,

FIG. 2 is a schematic representation of a multiband antenna in exploded view, FIG. 3 is a schematic representation of the ground plane carrying the radiating elements, in partially exploded view, FIG. 4 is a schematic representation of the disposition of the radiating elements and the separation walls, FIG. 5 is a representation in perspective of a separation wall with flange and flap, FIG. 6 is a representation of a second embodiment of a ground plane carrying the radiating elements according to the invention, FIGS. 7*a* and 7*b* are schematic representations of the disposition of the radiating elements and the separation walls according to two variations of the antenna of FIG. 6, FIG. 8 is a flowchart of the main steps to assemble an antenna as in the previous figures, FIGS. 9 and 10 are rectangular radiation plottings of an antenna as represented in FIGS. 3 and 4, respectively in the high and low band frequency domains.

In all figures, the same references apply to the same element.

Though the figures refer to precise embodiments of the invention, other embodiments may be obtained by combining or altering slightly the represented embodiments, said new embodiments are also within the scope of the invention.

FIG. 1 is a schematic representation of a wireless network 100. The network 100 is made by covering an area with a distribution of antennae 101, some of which are each associated with one network cell 103, here represented hexagonal, in which user equipments U roam using roaming rules and processes to select a preferred antenna 101 with respect to the geographical position, which is generally the one of the network cell 103 in which the user equipment is currently in use.

Data is exchanged with one user equipment U to and from an antenna 101. Further data is exchanged between network cells 103 using the backhauling architecture 105. This implies internal network communication using specific antennae 101, in particular directed multiband antennae generating cross polarized electromagnetic waves in the microwave, high (HF), very high (VHF) or ultra high (UHF) frequency domains (hundreds of megahertz MHz or a few to a few hundreds of gigahertz GHz).

These antennae 101 for intercellular communication are static, implemented in architecture elements such as walls, façades, poles or masts, and directed towards a receiver of the backhauling architecture 105, implemented in the maximum emission cone of the antenna 101.

One such antenna 101 is shown in more detail in FIG. 2. The antenna 101 of FIG. 2 is shown in exploded view.

The antenna 101 comprises a hull 1, formed by a bottom 3 and a lid 5. The hull 1 is made in particular in dielectric material (plastic materials in particular), and is rectangular, with a length axis A herein defined as horizontal, and the lid 5 is rounded on its upper side giving it the form of half a tube in longitudinal direction.

Inside the hull 1 is a ground plane 7 defining the horizontal plane in the figures, made of conducting material, for example a metal plate, which carries radiating elements 9, here in the form of dipole cross-motives. The radiating elements 9 are disposed in groups forming each an elementary antenna, said elementary antennae are arrayed along the longitudinal axis A.

The antenna 101, and in particular the hull 1 and ground plane 7 can further comprise attaching means, for the lid 5 to be attached to the bottom 3, and/or for the antenna 101 to be attached to a mast, pole, wall, column or arranged in a multi-array antenna structure comprising multiple antennae 101 in a motif.

The ground plane 7 and radiating elements 9 according to a first embodiment are shown in greater detail in FIG. 3.

FIG. 3 is a representation of the ground plane 7 carrying the radiating elements 9, in partially exploded view. The radiating elements 9 comprise in this antenna 101 two different subsets: high band 9*a* and low band 9*b* radiating elements, generating signals in two different bandwidths, respectively a high and a low frequency bandwidth.

FIG. 4 shows the ground plane 7 and the radiating elements 9 viewed from above along a vertical axis for better understanding of the disposition and dimensioning of the radiating elements 9.

The high band radiating elements 9*a* are placed on the arms of crosses so as to form two cooperating dipoles, inclined at ±45° with respect to the axis A. The high band radiating elements 9*a* are radiating patch antennae, placed on a dielectric support comprising two plates for example composite or resin printed circuit boards, forming a structure stretching in the vertical direction with a cross section in form of a Greek or Saint Andrew's cross, with four identical arms at a right angle with their neighbours.

The high band radiating elements 9*a* are placed on square, horizontal printed circuit boards 11, which are attached to the ground plane 7. The partially represented antenna 101 of FIG. 3 comprises five crossing sets of high band dipoles 9*a*, arranged at regular intervals along the longitudinal axis A.

The length of the arms of the cross carrying the high band radiating elements 9*a* is dependent on a central high band wavelength $\lambda_{HB}$ of the high band frequency interval, in particular it is often a dyadic fraction (noted $1/2^n$ in FIG. 4, where n is an integer) of said central high band wavelength $\lambda_{HB}$, especially 1, ½ or ¼ of said central high band wavelength $\lambda_{HB}$ (n=0, 1 or 2 in the formula of FIG. 4).

Around every second high band radiating element 9*a* cross are placed two low band dipoles, each comprising two elementary radiating elements, here L-band antenna strips, arranged vertically on the extremities of the arms of crosses, obtained by prolonging the same crosses carrying the high band radiating elements 9*a*.

The length of the arms of the dipole crosses forming the low band radiating elements 9*b* is dependent on a central low band wavelength $\lambda_{LB}$ of the low band frequency interval, greater than the central high band wavelength $\lambda_{HB}$ by a factor generally greater or equal to two. In particular said length of the arms is often a dyadic fraction (noted $1/2^n$ in FIG. 4) of said central low band wavelength $\lambda_{LB}$, especially 1, ½ or ¼ of $\lambda_{LB}$ (n=0, 1 or 2 in the formula of FIG. 4).

In particular, when using the scaling division of frequencies (with a factor 2 between neighbouring scales), the high band wavelength $\lambda_{HB}$ is generally equal to half the low band wavelength $\lambda_{LB}$.

This factor two relationship is also found in the spacing of the radiating elements 9*a*, 9*b*, in that the distance between two neighbouring low band dipole crosses 9*a* is twice the distance d between two neighbouring low band dipole crosses 9*b*.

Between the high and low band dipoles 9*a*, 9*b* are placed separation walls 13, which are tubular, here with a square cross-section, and made of metal like aluminium, e.g. from a folded and welded metal band or plate.

The high band dipoles 9*a* not surrounded by low band dipoles 9*b* are each placed inside a high band wall 15, also metallic and tubular with a square cross-section. The high band walls 15 present two wedge form recesses on the sides orthogonal to the longitudinal axis A. The recesses extend along the whole sides and are symmetric with respect to axis A.

The separation walls 13 and the high band walls 15 optimize the radio frequency performances of the antenna, in particular in terms of emission cone where the importance of the main frontal lobe is improved.

The separation walls 13 are common to both high band and low band radiating elements 9*a*, 9*b*, and play a role in the performances in both frequency domains in that they optimize the high band radio frequency performances, are an integral part of the low band component architecture, and reduce resonance effects between the high band and low band dipoles formed by the radiating elements 9*a*, 9*b*.

FIG. 5 shows in better detail one set of high band radiating elements 9*a*, with the surrounding separation wall 13 and one of the L-probes of the low band radiating elements 9*b*.

The tubular separation wall 13 is placed around the high-band dipole cross 9*a*, and comprises on its top a parasitic element 17, comprising a flange 19 and flaps 21.

The flange 19 is coplanar with the ground plane 7 and extends outwards from the top of the tubular separation wall 13. The flaps 21 are orthogonal to the ground plane 7, extending downwards (towards the ground plane 7) from the exterior outline of the flange 19, one for each of the four sides of the square cross section of the separation wall 13. The flaps 21 are trapezoidal, where the base of the trapeze extends along the whole upper side of the square separation wall 13 panel carrying it.

The flaps 21 may in particular be a 90° bent trapezoidal extension of the flange 19, the flange 19 and flaps 21 being for example stamped or cut out in a single metal plate or sheet.

The parasitic element 17 may in particular be manufactured separately, and assembled with the separation wall 13 either by complementary form cooperating, or by brazing, welding, riveting or screwing, in order to preserve an electric contact between the parasitic element 17 and the separation wall 13.

One of the low band radiating elements 9*b* (e.g. L-probe) is represented, with one of the high band radiating elements 9*a* cross patterns. As one can see, the low band radiating element 9*b* is placed on and aligned along the same cross pattern as the high band radiating elements 9*a*, and is covered by the flange 19.

In the corners of the flange 19, the diagonal width e is equal to the width of the low band radiating element 9*b*, and the overall height h of the tubular separation wall 13 is equal to that of said low band radiating element 9*b*. Other embodiments may have a flange only partially covering the low band radiating element 9*b*. The corners of the flange 19 thus form spaces to receive and support the low band radiating elements 9*b*, thereby protecting and maintaining them in their intended place and orientation.

Different polarization patterns can be obtained by coupling the diagonal L-probes in the cross-pattern of a radiating element 9*a*, 9*b* with given phase differences.

For example, to obtain a 45° cross polarization, the diagonally opposite L-probes are coupled to each-other with a 180° phase shift.

FIGS. 6, 7*a* and 7*b* are representations of other embodiments of the invention. In a similar representation as in FIGS. 3 and 4, they represent the ground plane 7 and radiating elements 9 respectively in perspective (FIG. 6) and viewed from above (FIGS. 7*a*, 7*b*).

The represented ground plane 7 and radiating elements 9*a*, 9*b* of an antenna 101 differ from those of FIGS. 3 and 4 in that the high band dipole crosses 9*a* are placed two by two inside the tubular separation walls 13. They are in particular arranged along the longitudinal axis A: the separation walls 13 each surround two high band dipole crosses 9*a* side by side. The dipoles of the low band radiating elements 9*b* are set in the corners of the separation wall 13, pointing outwards at a 45° inclination.

The sides of the separation walls 13 parallel to the longitudinal axis A are inclined outwards so as to generate a funnel antenna for the high band signal as visible in FIG. 6.

The pair of high band dipole crosses 9*a* inside a single tubular separation wall 13 can be placed on a common rectangular printed circuit board 11. In particular, the longitudinal sides of the rectangular printed circuit boards 11 correspond to the inferior sides of the inclined walls, and said circuit boards 11 extend longitudinally beyond the transverse walls of the separation walls 13, and may be electrically linked or formed as a single circuit board 11 extending through the length of the antenna 101.

In FIG. 7*a*, the high band radiating elements 9*a* and separation walls 13 are arranged so that the space between the separation walls 13 corresponds to the space occupied by one high band radiating element 9*a* (when regularly spaced), which is represented in dotted lines.

In FIG. 7*b*, the high band radiating elements 9*a* and separation walls 13 are arranged so that the space between the separation walls 13 corresponds to the space occupied by two high band radiating elements 9*a* (when regularly spaced), which are represented in dotted lines.

This configuration according to FIG. 7*b* is in particular indicated when the frequency domains of the high and low bands are separated by a factor 4 (two scales difference) or higher, since the high band radiating elements 9*a* are then consequently expected to be at least four times smaller than the low band radiating elements 9*b*.

FIG. 8 illustrates in a flowchart the main steps of the process 200 to assemble a multiband antenna 101 as previously described.

The first step 201 is placing the high band radiating elements 9*a* on the ground plane 7 along axis A, to generate the motives particularly visible in FIGS. 4, 7*a* and 7*b*. The second step 203 is placing the low band radiating elements 9*b* around subsets of the high band radiating elements 9*a*, for example once again according to the motives of FIGS. 4, 7*a*, 7*b*.

In the third step 205, the separation walls 13 are put in place and attached to the ground plane 7, for example using screws or rivets, and/or by brazing, welding or soldering.

An additional step 207 is the possible adding of the parasitic element 17 on top of the separation wall 13, so as to cover with a flange 19 at least a portion of the low band radiating elements 9*b*, possibly with flaps 21 as described above.

More complex antennae, in particular with three or more frequency bands may be obtained by adjoining elementary antennae 101 as described in an array, either in parallel, along a common axis, or in a star shape. Also, identical elementary antennae 101 may be adjoined to generate a stronger signal or a broader main emission lobe.

The plotted radiation patterns of an antenna 101 as described in FIGS. 3 and 4 are represented in FIGS. 9 and 10, respectively for a high band signal at 1.8 GHz (FIG. 9) and at a low band signal at 840 MHz (FIG. 10).

The radiation patterns of FIGS. 9 and 10 present each two graphs, in plain and dotted line, respectively showing the radiation pattern with separation walls (plain) and without separation walls (dotted). The graphs represent the emitted power in decibels dB using the emitted power along the vertical direction away from the ground plane (0°) as reference, as a function of the polar angle ▯ in degrees (°) in a plane orthogonal to the longitudinal axis A.

The radiation pattern with separation walls (plain line) in the high band domain of FIG. 9 shows a main emission lobe from approximately −90° to +90°, and a diffuse, reduced (−25 dB at peak) secondary lobe from −90° to −180° and from +90° to +180°.

This is an improvement when compared to the radiation pattern without separation walls (dotted line), where said pattern presents four nearly identical lobes. In particular, in the four lobe radiation pattern, the emitted radiation is spread wider over the 360° angle domain, and the useful radiated energy is therefore reduced (four peaks at −18 dB when compared to maximum peak with separation walls).

In the case of the low band domain, the main peak extends from approximately −150° to +150°, and a secondary, much lower lobe covers the rest. For comparison, the pattern without the separation walls 13 comprises a main peak covering the angular domain from −135° to +135°, with three maxima at −22 dB at −45°, −25 dB at 0° and −22 dB at +45°, and three other lesser lobes centred around +145°, 180° and −145° with peak values inferior to −30 dB.

The separation walls 13, in cooperation with the disposition of the high and low band radiating elements 9, 9*a*, 9*b* make for an improved overall radiated power by reducing the inter-frequency interferences, and the radiated power is concentrated in a main lobe in the vertical or frontal direction.

The proposed architecture also makes it possible to reduce the overall volume of the antenna 101, since the low band radiating elements 9*b* surround the high band radiating elements 9*a*.

The invention claimed is:

1. Multiband antenna, in particular for wireless networks, comprising: a ground plane extending along a longitudinal axis, high band radiating elements placed on the arms of crosses so as to form two cooperating dipoles, inclined at 45° with respect to the longitudinal axis, with an arm length being a dyadic fraction of a high-band wavelength, low band radiating elements placed on the arms of crosses so as to form two cooperating dipoles, inclined at 45° with respect to the longitudinal axis, with an arm length being a dyadic fraction of a low-band wavelength, wherein the high and low band radiating elements crosses are arranged along the longitudinal axis of the ground plane, in that the antenna comprises tubular separation walls in electric contact with the ground plane, and in that the crosses are arranged in a pattern, wherein: at least part of the high band radiating elements are set inside the tubular separation walls, the low band radiating elements are completely outside of and placed around the tubular separation walls, the low band radiating elements being placed on the arms of crosses with junctions inside the tubular separation walls.

2. Multiband antenna according to claim 1, wherein the high band radiating elements are arranged at a regular interval along the longitudinal axis of the ground plane and in that every second high band radiating elements is surrounded by a tubular separation wall.

3. Multiband antenna according to claim 1, wherein the high band radiating elements are arranged at a regular interval along the longitudinal axis of the ground plane, and in that said high band radiating elements are placed two by two inside the tubular separation walls.

4. Multiband antenna according to claim 1, wherein the high band and low band radiating elements respectively inside and outside a tubular separation wall are aligned along a common cross pattern.

5. Multiband antenna according to claim 4, wherein the separation wall presents a square cross section, at the corners of which are placed the low band radiating elements.

6. Multiband antenna according to claim 1, wherein the tubular separation walls comprise a parasitic element comprising an outward protruding flange of metallic material that covers at least partially the low band radiating elements.

7. Multiband antenna according to claim 6, wherein the parasitic element further comprises four flaps, folded so as to be perpendicular to the ground plane and pointing towards said ground plane.

8. Multiband antenna according to claim 1, wherein the high and low band radiating elements are placed on printed circuit boards screwed or riveted to the ground plane, and in that the tubular separation walls are brazed, welded or soldered to the ground plane.

9. Multiband antenna according to claim 8, wherein the outlines of the printed circuit boards are parallel to the tubular separation wall surrounding it.

10. Multiband antenna according to claim 1, wherein the high and low band radiating elements comprise diagonally opposite L-probes which are coupled to each-other with a 180° phase shift.

11. Process for obtaining a multiband antenna, comprising: Arranging, on a ground plane, high band radiating elements on the arms of crosses so as to form two cooperating dipoles, inclined at 45 degrees with respect to a longitudinal axis of the ground plane, with an arm length being a dyadic fraction of a high-band wavelength, arranging, on the ground plane, low band radiating elements around a subset of the high band radiating elements on the arms of crosses so as to form two cooperating dipoles, inclined at 45 degrees with respect to the longitudinal axis, with an arm length being a dyadic fraction of a low-band wavelength, soldering, welding or brazing of tubular separation walls around at least the subset of the high band radiating elements, placed so that the tubular separation walls surround at least part of the high band radiating elements, and so that the low band radiating elements are completely outside the separation walls and point outwards of the tubular separation walls, the low band radiating elements being placed on the arms of crosses with junctions inside the tubular separation walls.

12. Process according to claim 11, wherein it further comprises:

placing a metallic parasitic element on top of the tubular separation walls, comprising an outwards protruding flange covering at least partially the low band radiating elements.

* * * * *